US011335549B2

(12) United States Patent
Shan

(10) Patent No.: US 11,335,549 B2
(45) Date of Patent: May 17, 2022

(54) EXCIMER LAMP

(71) Applicant: LED Smart Inc., Surrey (CA)

(72) Inventor: Xinxin Shan, Surrey (CA)

(73) Assignee: LED Smart Inc., Surrey (CA)

( * ) Notice: Subject to any disclaimer, the term of this patent is extended or adjusted under 35 U.S.C. 154(b) by 0 days.

(21) Appl. No.: 17/091,996

(22) Filed: Nov. 6, 2020

(65) Prior Publication Data

US 2022/0084808 A1 Mar. 17, 2022

(30) Foreign Application Priority Data

Sep. 15, 2020 (CA) ..... 3093096

(51) Int. Cl.

| | |
|---|---|
| ***F21V 29/70*** | (2015.01) |
| ***H01J 65/04*** | (2006.01) |
| ***F21V 29/503*** | (2015.01) |
| ***H05B 33/06*** | (2006.01) |

(52) U.S. Cl.

CPC ..... *H01J 65/046* (2013.01); *F21V 29/503* (2015.01); *F21V 29/70* (2015.01); *H05B 33/06* (2013.01)

(58) Field of Classification Search

CPC ..... F21V 29/503; F21V 29/70; H01J 65/046

USPC ..... 362/257

See application file for complete search history.

(56) References Cited

U.S. PATENT DOCUMENTS

| | | | | |
|---|---|---|---|---|
| 10,780,189 | B2 | 9/2020 | Randers-Pehrson et al. | |
| 10,786,586 | B2 | 9/2020 | Igarashi | |
| 2018/0082830 | A1* | 3/2018 | Ellis | H01J 61/34 |
| 2019/0096656 | A1* | 3/2019 | Do | H01J 61/04 |

FOREIGN PATENT DOCUMENTS

| | | | |
|---|---|---|---|
| CN | 212625484 U | * | 2/2021 |
| CN | 213752626 U | * | 7/2021 |

OTHER PUBLICATIONS

Downloaded from www.researchgate.net: Manuela Buonanno et al: "207-nm UV Light—A Promising Tool for Safe Low-Cost Reduction of Surgical Site Infections.I: In Vitro Studies"; Oct. 2013; p. 1-8.

(Continued)

*Primary Examiner* — Christopher M Raabe

(74) *Attorney, Agent, or Firm* — Christensen O'Connor Johnson Kindness PLLC

(57) ABSTRACT

An excimer lamp, which includes a first lamp cap, a second lamp cap, a first electrode head, a second electrode head, a conductive heat dissipation rod, a light-transparent annular sleeve, and a conductive annular net. The heat dissipation rod and conductive annular net are respectively connected to the first and second electrode heads to excite an excimer gas in the light-transparent annular sleeve. Inside the excimer lamp the, a large amount of heat can be conducted and dissipated through the conductive heat dissipation rod, and then through the heat dissipation of the first lamp cap or by heat conductive annular rings between sections of the lamp. At the same time, the conductive annular nets can also conduct and dispatch a large amount of above mentioned heat; the heat may be further conducted and dispatched through the second lamp cap or through the heat conductive annular rings, if present.

29 Claims, 14 Drawing Sheets

(56) References Cited

OTHER PUBLICATIONS

Downloaded from www.nature.com/scientificreports: Manuela Buonanno et al: "FAR-UVC Light (222 nm) Efficiently and Safely Inactivates Airborne Human Coronaviruses", 2020; 1-8.
Manuela Buonanno et al: "Germicidal Efficacy and Mammalian Skin Safety of 222-nm UV Light"; Radiation Research 187; p. 493-501; 2017.
Downloaded from https://doi.org: "Chronic Irradiation With 222-nm UVC Light Induces Neither DNA Damage nor Epidermal Lesions in Mouse Skiin, Even at High Doses"; Kouji Narita et al.; published Jul. 25, 2018; p. 1-9.
Kouji Narita et al.: "Disinfection and Healing Effect of 222-nm UVC Light on Methicillin-Resistant *Staphylococcus aureus* Infection in Mouse Wounds"; Journal of Photochemistry & Photobiology, B: Biology 178 (2018); p. 10-18.
Downloaded from magonlinelibary.com: Jun Chance Goh et al: Disinfection Capabilities of 222nm Wavelength Ultraviolet Lighting Device: A Pilot Study; Journal of Wound Care: vol. 30, No. 2, Feb. 2021; p. 96-104.

* cited by examiner

EXCIMER LAMP

TECHNICAL FIELD

The invention relates to the technical field of lighting fixtures, especially excimer lamps.

BACKGROUND

The excimer lamp, also known as the ultraviolet excimer lamp, uses high voltage and high frequency electricity outside the lamp tube to bombard the excimer gas in the lamp tube to emit ultraviolet rays. Because the photon energy of the emitted ultraviolet rays is higher than most organic molecular bond enthalpies, using its single high-intensity ultraviolet light, good light cleaning and light modification can be achieved in the manufacture of semiconductors and LCD screens, with excellent processing effects and high speed.

After working for a period of time, the temperature of the excimer lamp will increase, which will cause the excitation efficiency to drop sharply. Therefore, to maintain the excitation efficiency of the excimer lamp, the heat dissipation of the excimer lamp becomes very important. In addition, when the excimer lamp is used, it requires a high voltage to excite the excimers. It is necessary to implement anti-shock features in the structural design of the excimer lamp to prevent personal injury.

SUMMARY

An excimer lamp is provided having a conductive heat dissipation rod having a first end and a second end, and extending in a longitudinal direction from the first end to the second end. A first lamp cap is connected to the first end of the conductive heat dissipation rod, the first lamp cap being thermally conductive but electrically non-conductive. A first electrode head is installed in the first lamp cap, the first electrode head being configured to connect to an external power source, and the first electrode head being electrically connected to the conductive heat dissipation rod. A light-transparent annular sleeve extends in the longitudinal direction, the light-transparent annular sleeve arranged around the conductive heat dissipation rod and defining a gas containment space filled with an excimer gas. A conductive annular net is arranged around the light-transparent annular sleeve and extends in the longitudinal direction. A second electrode head is electrically connected to the conductive annular net and configured to connect to the external power source. A second lamp cap is connected to the second end of the conductive heat dissipation rod, the second lamp cap being thermally conductive but electrically non-conductive.

In various embodiments there may be provided any one or more of the following features:

The second lamp cap may be installed around the second electrode head. The second electrode head may comprise a second electrode head inner connecting section connected to a contact for electrically connecting the second electrode head to the conductive ring net. The contact may be separated from the conductive heat dissipation rod by an insulator and the second electrode head may also comprise a second electrode head outer connecting section connected to a second electrode buckle for supplying external power from the external power source through the second electrode head. The second electrode buckle may extend out of the second lamp cap, a connecting portion connecting to the second electrode head outer connecting section within the second lamp cap. The second electrode buckle may be connected to the second electrode head using a bayonet slot connection. A second electrode buckle protective sleeve may surround an outer surface of the second electrode buckle, the second electrode buckle protective sleeve including an outwardly projecting ring adjacent to an outer surface of the second lamp cap. The contact may comprise a flange. The second electrode head may extend through a restriction in the second lamp cap and the second lamp cap may be constrained around the second electrode head in part by the flange. The conductive ring net may have an end which bends inwardly around the flange to form an annular ring in contact with the flange. The annular ring may be pressed against the flange. The contact may be threadedly connected to the second electrode head inner connecting section. The insulator separating the contact from the conductive heat dissipation rod may be a ceramic insulator. The insulator may include an insulator connecting section in mating contact with the conductive heat dissipation rod.

The light-transparent annular sleeve may comprise an inner sleeve and an outer sleeve, the outer sleeve connecting to the inner sleeve to enclose and define the gas containment space between the inner sleeve and the outer sleeve. The excimer lamp may also comprise a conductive heat dissipation tube extending in the longitudinal direction and having an inner wall surrounding the conductive heat dissipation rod and separated from the conductive heat dissipation rod by a gap, the gap filled with an elastic conductive material. The conductive heat dissipation tube may also have an outer wall adjacent to the inner sleeve. There may be more than one light transparent annular sleeve, the more than one light transparent annular sleeves being separated axially by rings adapted to dissipate heat.

The first electrode head may include a first electrode head inner connecting section having an external thread threadedly connected with the conductive heat dissipation rod. The first electrode head may include a first electrode head outer connecting section, the excimer lamp further comprising a first electrode buckle for clamping with the first electrode head outer connecting section, the first electrode buckle having a first insertion section embedded in the first lamp cap and a first extension section protruding from the first lamp cap for connection to the external power source. The first electrode buckle may be connected to the first electrode head using a bayonet slot connection. A first electrode buckle protective sleeve may surround an outer surface of the first electrode buckle, the first electrode buckle protective sleeve including an outwardly projecting ring adjacent to an outer surface of the first lamp cap.

The excimer lamp may dissipate a large amount of heat generated in the light-transparent annular sleeve through the conductive heat dissipation rod and thence through the first lamp cap. At the same time, a large amount of heat generated in the light-transparent annular sleeve may be dissipated and conducted through the conductive ring net. This heat may then be dissipated through the second lamp cap. Annular heat dissipation rings, if present, can also dissipate the heat conducted through the rod and net, and may also receive heat directly from the light-transparent annular sleeve. This structural arrangement greatly improves the heat dissipation efficiency of the entire excimer lamp, and easily conducts out the heat inside the light-transparent annular sleeve. The temperature inside the annular sleeve can be lowered to a certain level, so that the excitation efficiency of the excimer lamp can be stabilized. Thereby the lamp can generate continuous and stable ultraviolet light.

A fixture may be provided including an excimer lamp. The fixture may have a housing containing the excimer lamp and a window extending along the housing. There may be one or more lenses in the window. The lens or lenses may comprise a wavelength filter. There may be reinforcement bars arranged between plural lenses. A mirror within the housing may be arranged to direct light from the excimer lamp to the window. The mirror may be an interior surface of the housing. The fixture may have a first fixture end cap at a first end of the fixture, a portion of the excimer lamp extending through the first fixture end cap. The lamp may be energized via power flow between a first terminal and a second terminal, the first terminal being connected to the portion of the excimer lamp extending through the first fixture end cap, and the second terminal being connected to the excimer lamp via a conduit through the first fixture end cap.

DETAILED DESCRIPTION

Figure 1:
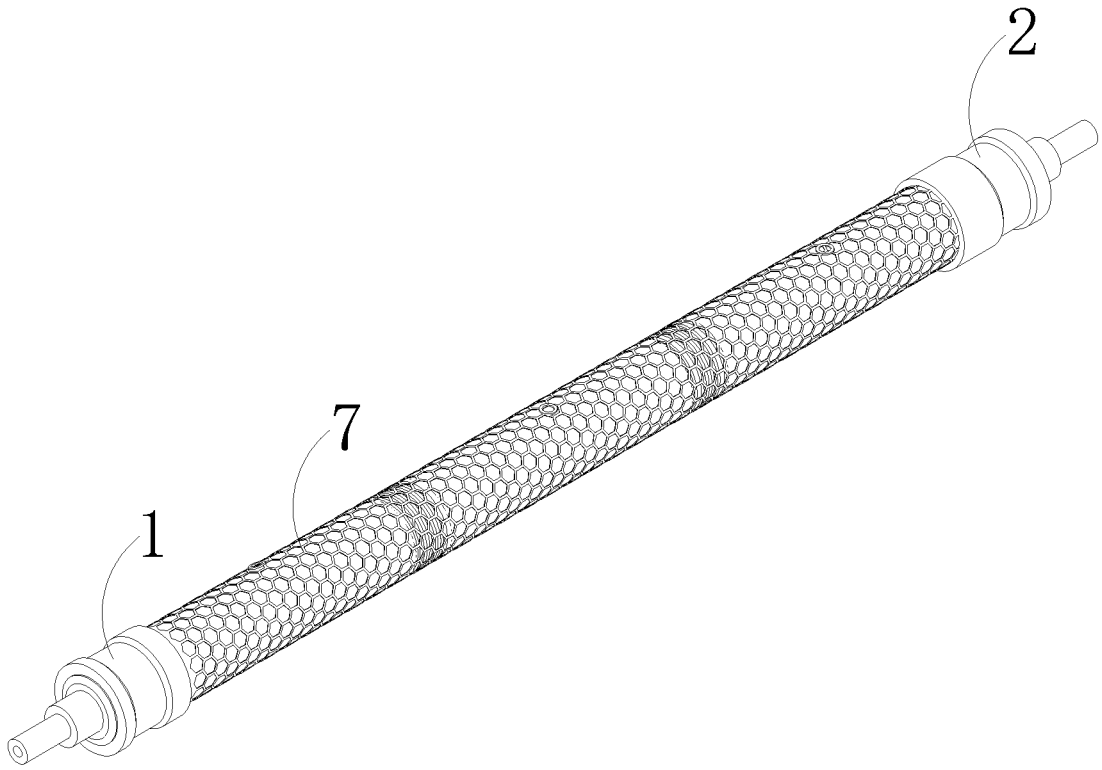
FIG. 1 is a isometric view of an embodiment of an excimer lamp.
Figure 2:
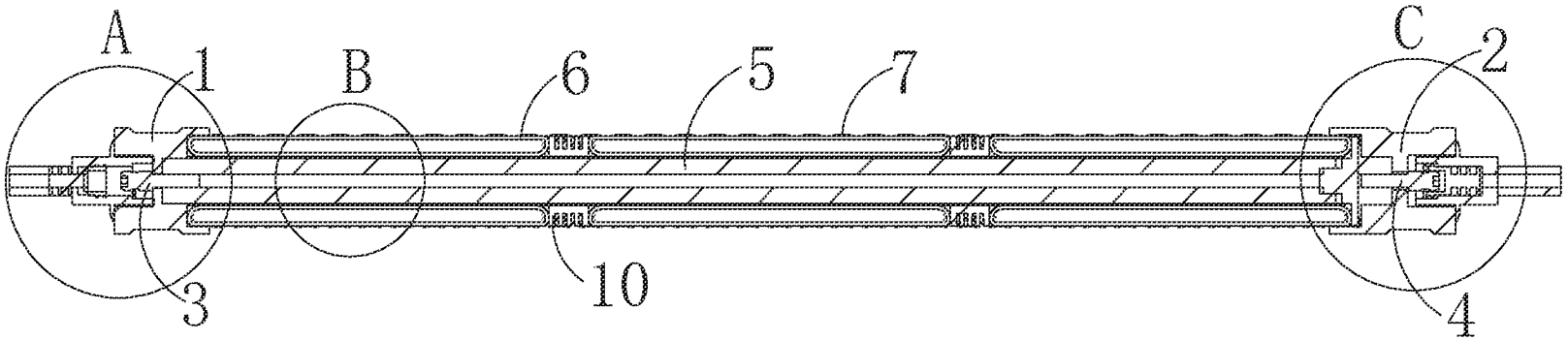
FIG. 2 is a cross-sectional view of the excimer lamp of FIG. 1, and showing areas A, B and C represented in closeups in FIGS. 3, 4 and 5 respectively.

In order to make clearer the objectives, technical solutions, and advantages of the present invention, the detailed descriptions with reference to the accompanying drawings and embodiments are as follows. It should be understood that the specific embodiments described here are only used to explain the present invention, but not to limit the present invention as defined by the claims.

The same or similar reference symbols in the drawings of this embodiment correspond to the same or similar components; It should be understood that in the description of the present invention, if there are the terms "upper", "lower", "left", "right", etc., the indicated orientation or positional relationship is based on the orientation or positional relationship shown in the drawings, and is only for the convenience of describing the present invention and simplifying the description, and does not indicate or imply that the described device or element must have a specific orientation, or be assembled or operated at the specific orientation. Therefore, the terms describing the positional relationship in the drawings are only used for exemplary description and cannot be understood as a limitation of this patent. For those ordinary technicians in this field, the specific meanings of the above terms can be understood according to the specific circumstances.

The implementation of the present invention will be described in detail below in conjunction with specific embodiments.

FIGS. 1 to 12 provide an exemplary embodiment of the present invention.

The exemplary excimer lamp comprises:

a first lamp cap 1, the first lamp cap 1 being made of a thermally conductive but electrically non-conductive material;

a second lamp cap 2, the second lamp cap 2 arranged opposite to the first lamp cap, and the second lamp cap 2 being made of a thermally conductive but electrically non-conductive material;

a first electrode head 3, the first electrode head 3 being installed in the first lamp cap 1, and the first electrode head 3 being used to connect to an external power source;

a second electrode head 4, the second electrode head 4 being installed in the second lamp cap 2, and the second electrode head 4 being used to connect to an external power source;

a conductive heat dissipation rod 5, the conductive heat dissipation rod having first and second ends being installed in the first lamp cap 1 and the second lamp cap 2 respectively, and the conductive heat dissipation rod 5 being electrically connected to the first electrode head 3;

a light-transparent annular sleeve 6, the light-transparent annular sleeve 6 being arranged surround the conductive heat dissipation rod 5, and extending in a direction consistent with a direction of extent of the conductive heat dissipation rod 5, the annular sleeve having a housing space in which excimer gas is filled in the accommodating space; and a conductive ring net 7, the conductive ring net 7 being arranged to surround the light-transparent annular sleeve 6, and extending in a direction consistent with a direction of extent of the light-transparent annular sleeve 6. One end of the conductive ring net 7 is electrically connected to the second electrode head 4.

The operation of the above-mentioned embodiment of an excimer lamp is described as follows. The first electrode head 3 is connected to the electrical power source, and the conductive heat dissipation rod 5 is electrically connected to the first electrode head 3. The second electrode head 4 is connected to the electrical power source, and the second electrode head 4 is electrically connected to the conductive ring net 7. The light-transparent annular sleeve 6 is arranged around the conductive heat dissipation rod 5, and the conductive ring net 7 is arranged around the light-transparent annular sleeve 6, and thus the conductive ring net and conductive heat dissipation rod form two oppositely arranged electrodes on the inside and outside of the light-transparent annular sleeve 6. A discharge space is formed between these two electrodes. If a sufficiently high discharge voltage is applied to the two electrodes, the excimer gas inside the light-transparent annular sleeve 6 in the discharge space will be broken down, forming a dielectric barrier discharge, and generating ultraviolet light. The electrodes may be energized with alternating current with a voltage offset such that the electric field between the electrodes does not change direction. The relatively positive electrode (anode) may be the conductive heat dissipation rod 5 and the relatively negative electrode (cathode) may be the conductive ring net 7. The voltage may be provided in the form of for example a sinusoidal wave, square wave or sharp pulse wave. A single such wave form or mix of wave forms could be used. In the case of square wave and pulse wave, the negative terminal may be grounded (0V). The voltage on the anode is always positive higher than the voltage on the cathode (0V). In the case of sinusoid wave, in an embodiment the cathode is not grounded, but floated. The voltage between the anode and the cathode can be higher than 0 (the first half sinusoid cycle), or lower than 0 (the second half sinusoid cycle). The UVC light is emitted only when the voltage of inner terminal is much higher than the voltage of the outer terminal (in an example by above about 10 KV). Light from the light-transparent annular sleeve 6 may exit the lamp through mesh holes in the conductive ring net 7.

In the excimer lamp mentioned above, through the arrangement of the conductive heat dissipation rod 5, a large amount of heat generated in the light-transparent annular sleeve 6 is dissipated and conducted through the conductive heat dissipation rod 5. The heat is then conducted through the heat dissipation of the first lamp cap 1. At the same time, a large amount of heat generated by the lighting in the light-transparent ring sleeve 6 can be dissipated and conducted by the conductive ring net 7, through the second lamp cap 2. This structural arrangement greatly improves the heat dissipation efficiency of the entire excimer lamp. Through conducting of the heat out of the light-transparent annular sleeve 6, the temperature inside the light-transparent annular sleeve 6 can be lowered. Thereby the excitation efficiency of the excimer lamp can be stabilized, and continuous and stable ultraviolet light can be generated.

The heat dissipation rod 5 may define a central bore as shown in the figures. The central bore may include threads at the ends or over the whole length to form threaded connections with other components at each end.

It should be noted that the excimer gas refers to a gas that forms molecules when electrically excited that are not stable and decay to produce light. The gas is typically a mixture of an inert gas and a halogen gas. For example, the excimer gas can comprise Krypton and Chlorine to produce UVC light at a wavelength of 222 nm. A narrow band filter (not shown) may be used to obtain pure 222 nm wavelength light.

In an exemplary embodiment, the first lamp cap 1 and the second lamp cap 2 are made of ceramic materials. The ceramic material has good thermal conductivity, and is electrical non-conductive. Furthermore, the light-transparent annular sleeve 6 can be made for example of glass, e.g. silica glass, or sapphire. The conductive ring net 7 and the conductive heat dissipation rod 5 can be made of metal materials. Metals have both conductive performance and good heat dissipation performance.

Figure 4:
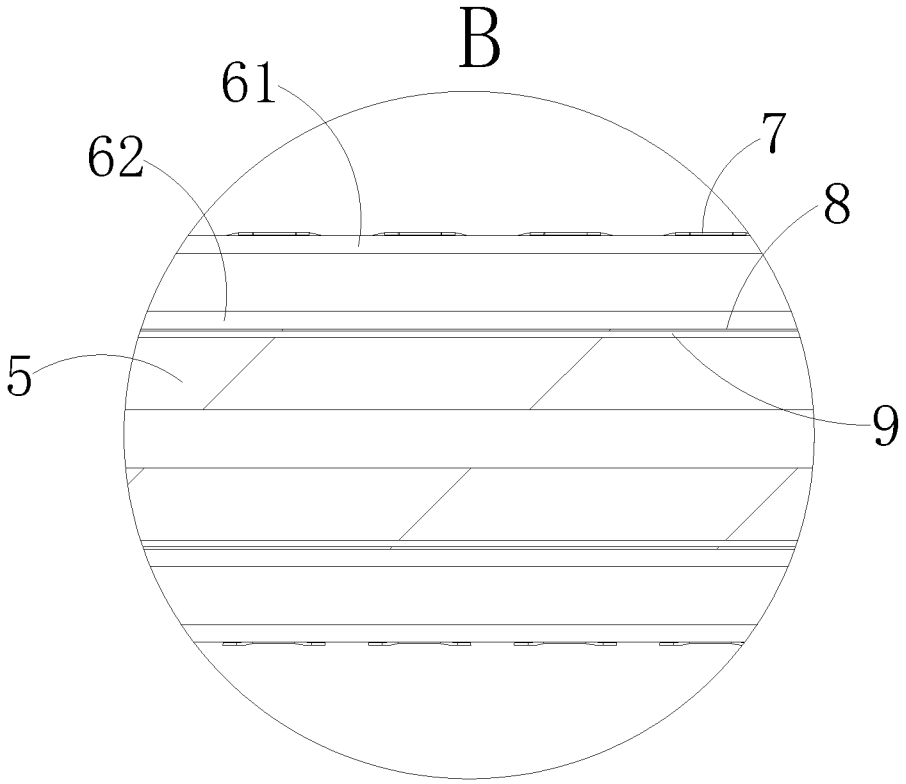
FIG. 4 is a closeup cross sectional view of area B in FIG. 2.

As seen in FIG. 4, the light-transparent annular sleeve 6 in the embodiment shown includes an inner tube 61 and an outer tube 62 which is connected to the inner tube 61. There is a gap between the inner tube 61 and the outer tube 62, and the gap forms an accommodating space. The excimer gas is contained in the accommodating space.

Figure 9:
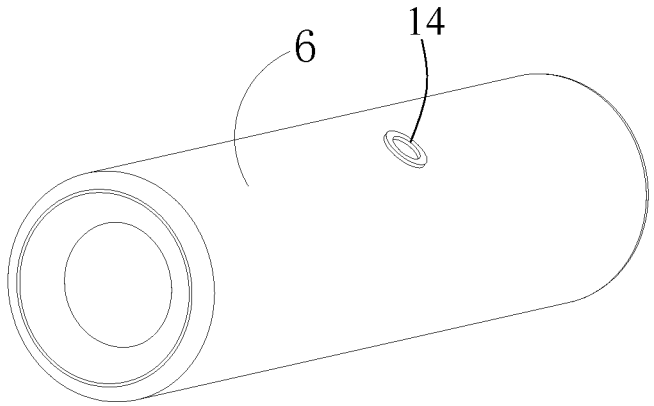
FIG. 9 is an isometric view of a light-transparent annular sleeve of the excimer lamp of FIG. 1.

There may be an opening 14 on the light-transparent annular sleeve 6, for example as shown in FIG. 9, which connects to the accommodating space. There may also be a tube cover on the light-transparent annular sleeve for opening or closing the opening. When it is necessary to fill the excimer gas into the light-transparent annular sleeve 6, the tube cover may be opened. The excimer gas can then be injected into the transparent annular sleeve 6 at the opening. After the excimer gas is filled, the tube cover is then closed.

In an embodiment of the present invention, also shown in FIG. 4, the excimer lamp also includes a conductive heat dissipation tube 8. The conductive heat dissipation tube 8 has a direction of extent consistent with a direction of extent of the conductive heat dissipation rod 5. The inner wall of the conductive heat dissipation tube 8 is arranged to surround the conductive heat dissipation rod 5. There is a gap between the heat dissipation tube 8 and the conductive heat dissipation rod 5. The gap is filled with elastic conductive material 9.

The outer wall of the conductive heat dissipation tube 8 is attached to the inner tube 61 of the light-transparent annular sleeve 6. In the embodiment shown, through filling in the gap with elastic conductive material 9, such as a metal mesh, an electrical connection is realized between the conductive heat dissipation rod 5 and the conductive heat dissipation tube 8. This makes the conductive heat dissipation tube 8 form part of the electrode formed by the conductive heat dissipation rod 5 and opposite to the electrode formed by the conductive ring net 7. These opposite electrodes can be used to excite the excimer gas inside the light-transparent annular sleeve 6. At the same time, due to the large amount of heat generated by the light-transmitting annular sleeve 6 when it emits light, the light-transparent annular sleeve 6 is prone to thermal expansion. Because the inner tube 61 of the light-transparent annular sleeve 6 is attached to the outer wall of the conductive radiating tube 8, there is a gap between the conductive dissipation tube 8 and the conductive dissipation rod 5, and the gap is filled with elastic conductive material, in this way, even if the light-transparent annular sleeve 6 undergoes thermal expansion, the annular sleeve 6 has a certain thermal expansion and deformation space, and will not be broken due to squeezing. This improves the lifetime of the light-transparent annular sleeve 6. At the same time, the light-transparent annular sleeve 6 can remain in contact with the conductive dissipation rod 5 through the elastic conductive material 9 to aid in heat dissipation. In an embodiment, the conductive heat tube 8 is made of metal with better electrical conductivity and thermal conductivity.

Figure 10:
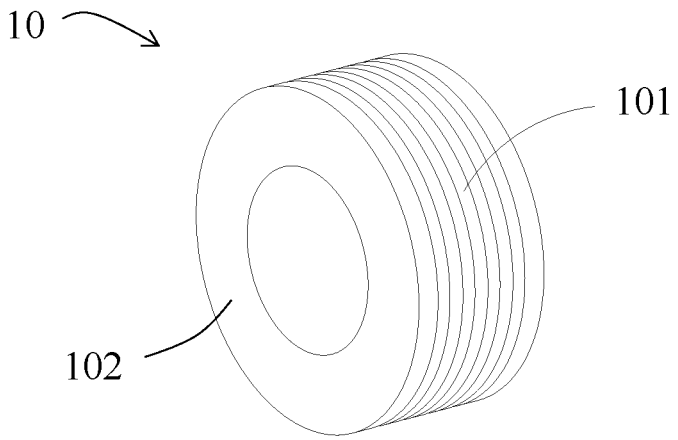
FIG. 10 is a three-dimensional schematic diagram of an annular heat dissipation ring of the excimer lamp of FIG. 1.

If the length of the light-transparent annular sleeve 6 is long, a large amount of heat will be generated during the working process. Therefore, in an embodiment of the present invention, there are multiple light-transmitting annular sleeves 6, and along the extending direction of the light-transparent annular sleeve 6, the plurality of the light-transparent annular sleeves is arranged in sequence with intervals. There may be heat dissipation units 10 between each two adjacent light-transparent sleeves, shown here in the form of annular rings. For example, as shown in FIG. 10, each heat dissipation unit may comprise plural annular heat dissipation fins 101 on a heat conductive sleeve 102. The ring-shaped heat dissipation units 10 in this embodiment are sleeved on the outer circumference of the conductive heat tube 8. The two axial ends of the ring-shaped heat dissipation units 10 abut two ends of the adjacent light-transparent annular sleeves. The annular heat dissipation units 10 are electrically isolated and may be made of an oxidized ceramic material with better thermal conductivity. This arrangement is very conducive to the dissipation of heat generated by the light-transparent annular sleeve 6. The conductive ring net 7 may be a single net extending around the light transparent annular sleeves 6 and the heat dissipation units 10 collectively.

Figure 5:
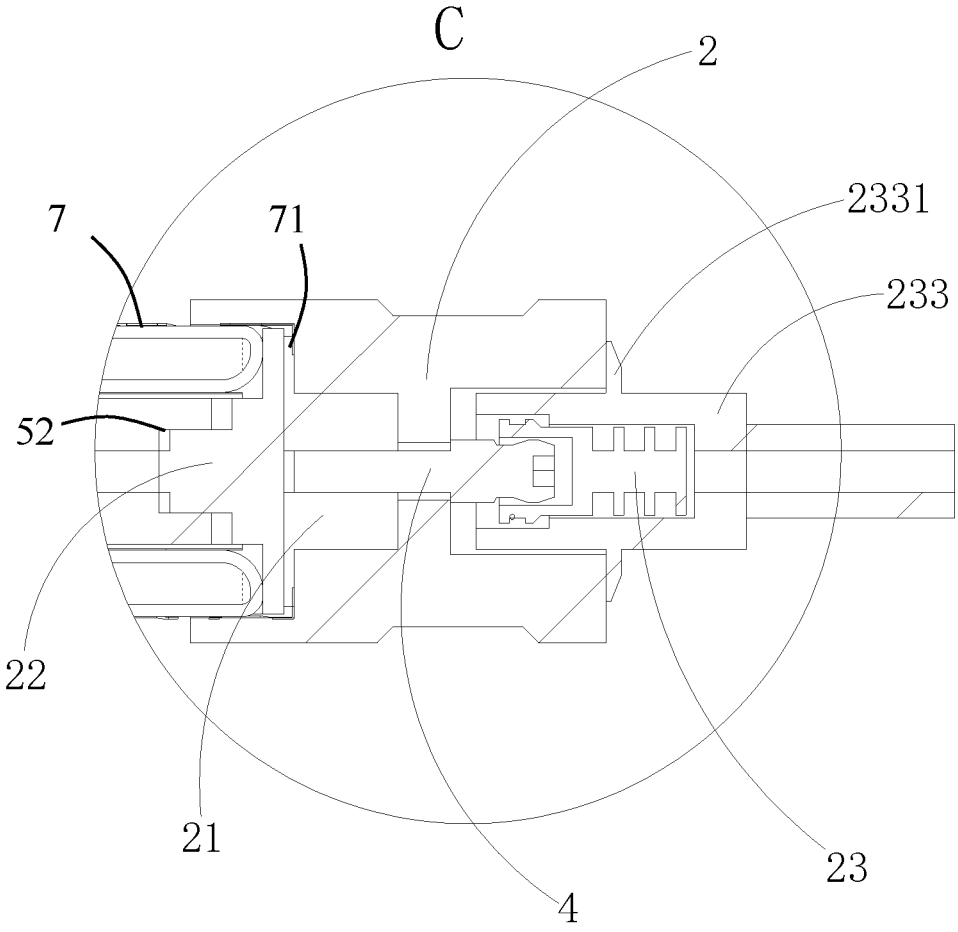
FIG. 5 is a closeup cross sectional view of area C in FIG. 2.
Figure 7:
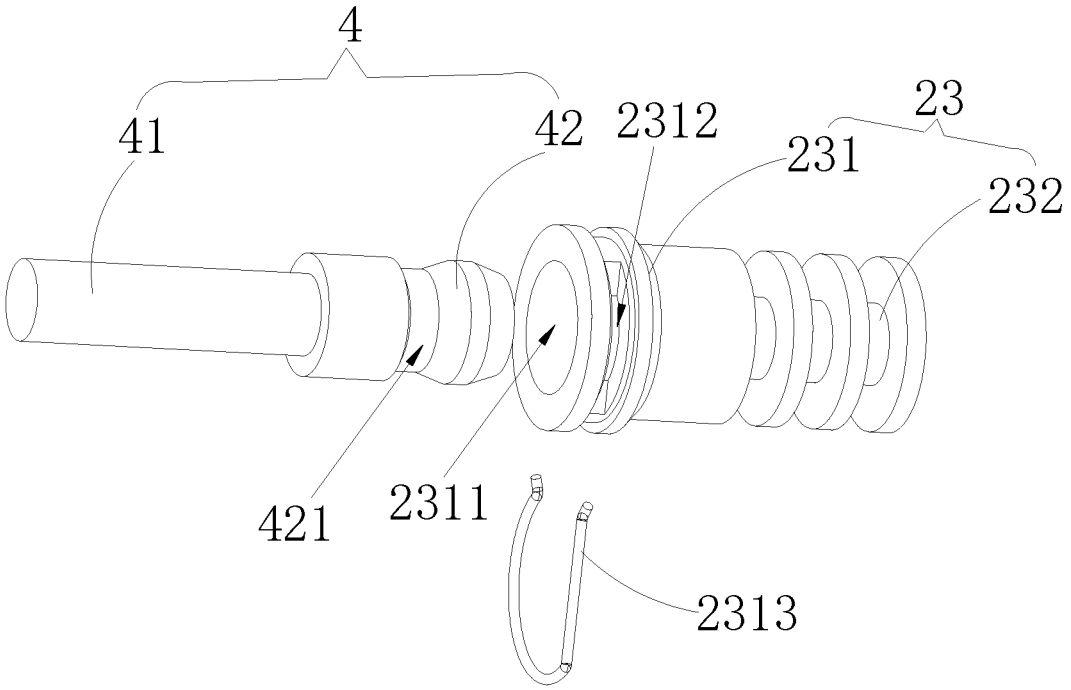
FIG. 7 is an exploded view of a second electrode buckle and a second electrode head of the excimer lamp of FIG. 1.
Figure 8:
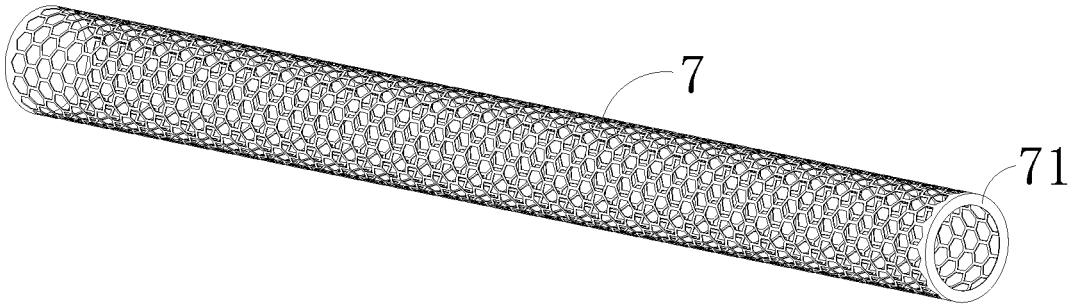
FIG. 8 is an isometric view of a conductive ring net of the excimer lamp of FIG. 1.
Figure 11:
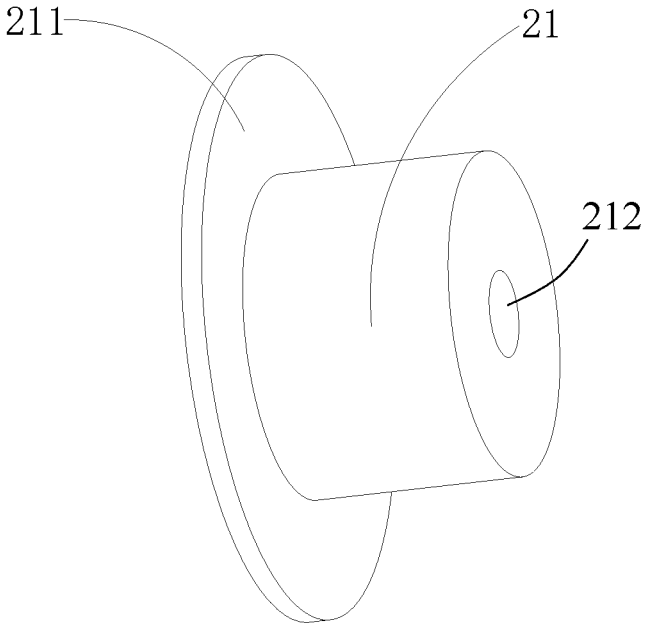
FIG. 11 is a three-dimensional schematic view of a fixing nut of the excimer lamp of FIG. 1.
Figure 12:
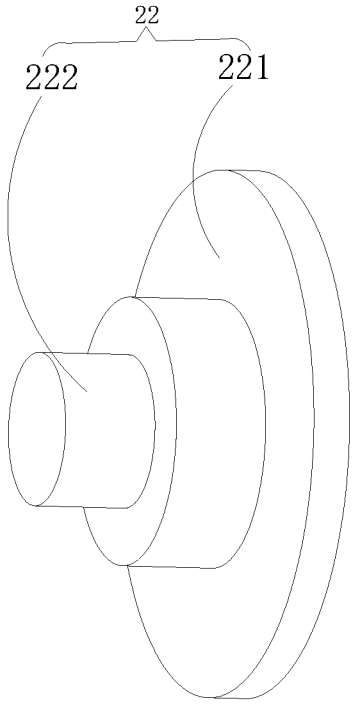
FIG. 12 is a three-dimensional schematic diagram of an insulating ceramic of the excimer lamp of FIG. 1.

In an embodiment, as shown in FIG. 7, the second electrode head 4 includes an inner connecting section 41 and an outer connecting section 42. As shown in FIG. 8, the end of conductive ring net 7, which is close to the above mentioned second electrode head 4, may inwardly bulge to form an annular ring 71. As shown in FIG. 11, there may be a conductive fixing nut 21 in the second lamp cap 2. There is a threaded hole 212 on the fixing nut 21. There is a fixing part 211, here a flange, on the annular ring near the fixing nut 21. In this embodiment, the fixing part 211 is compressed tightly toward the annular ring 71 of the conductive ring net 7. The fixing part 211 forms an electrical contact for connecting the second electrode head 4 to the conductive ring net 7. The inner connecting section 41 of the second electrode head, shown in FIG. 7, may have an external thread. The inner connecting section 41 of the second electrode head 4 in this embodiment is threadedly connected with the fixing nut 21. Through the arrangement of this structure, the electrical connection between the conductive ring net 7 and the second electrode head 4 is realized. Other connections may also be used. The overall arrangement of the components shown in FIGS. 7, 8, 11 and 12 is best seen in FIG. 5.

Furthermore, there may be isolating ceramics 22 in the second lamp cap 2. There are a squeezing section 221 and an insulator connecting section 222 inside the isolating ceramics. The squeezing section 221 is used to press tightly on the fixing part 211 of the fixing nut 21. The insulator connecting section 222 is in mating contact with the conductive heat dissipation rod 5. The isolating ceramic 22 isolates the conductive heat dissipation rod 5 and the fixing nut 21. The squeezing section 221 of the isolating ceramic 22 compresses tightly the fixing portion 211 of the fixing nut 21, and then compresses tightly the annular ring 71 of the conductive ring net 7. This realizes the fixation of the conductive ring net 7. The isolating ceramic 22 isolates the conductive heat dissipation rod 5 and the fixing nut 21, which is also to realize the isolation between the conductive heat dissipation rod 5 and the second electrode head 4. The force applied to the squeezing section 221 to press it against the fixing part 211 may be supplied through a compressive force carried by the conductive heat dissipation rod 5. A corresponding tension force may be formed in the conductive ring net 7 as the annular ring 71 of the conductive ring net 7 is pushed by the compressive force through the rod 5, squeezing section 221 and fixing part 211. Compressive force may be supplied to the conductive heat dissipation rod 5 by loosening the threaded connection, described below, between an inner connection section 31 of the first electrode head 3, and the conductive heat dissipation rod 5.

In an embodiment, there is a groove 52 in the conductive heat dissipation rod 5 near where the insulator connection section 222 of the isolating ceramics 22 connects to the conductive heat dissipation rod 5. The insulator connection section 222 may be embedded in the groove to achieve mating contact with the conductive heat dissipation rod 5.

Figure 6:
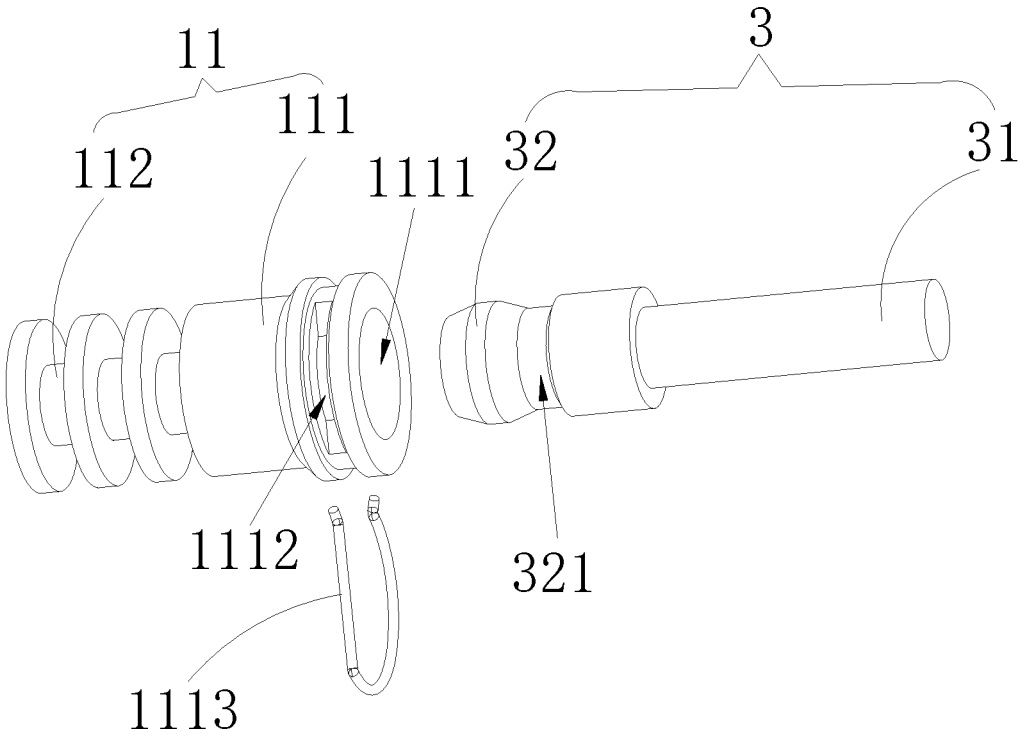
FIG. 6 is an exploded view of a first electrode buckle and a first electrode head of the excimer lamp of FIG. 1.

In an embodiment, there is a threaded groove (not shown) on one end of the conductive heat dissipation rod 5 near the first electrode head 3. As shown in FIG. 6 there are a first electrode head inner connection section 31 and a first electrode head outer connection section 32 on the first electrode head 3. There is an external thread on the inner connection section 31. The inner connecting section 31 of the first electrode head 3 is threadedly connected with the threaded groove of the conductive heat dissipation rod 5. In this way, the conductive heat dissipation 5 electrically connects to the first electrode head 3.

Figure 3:
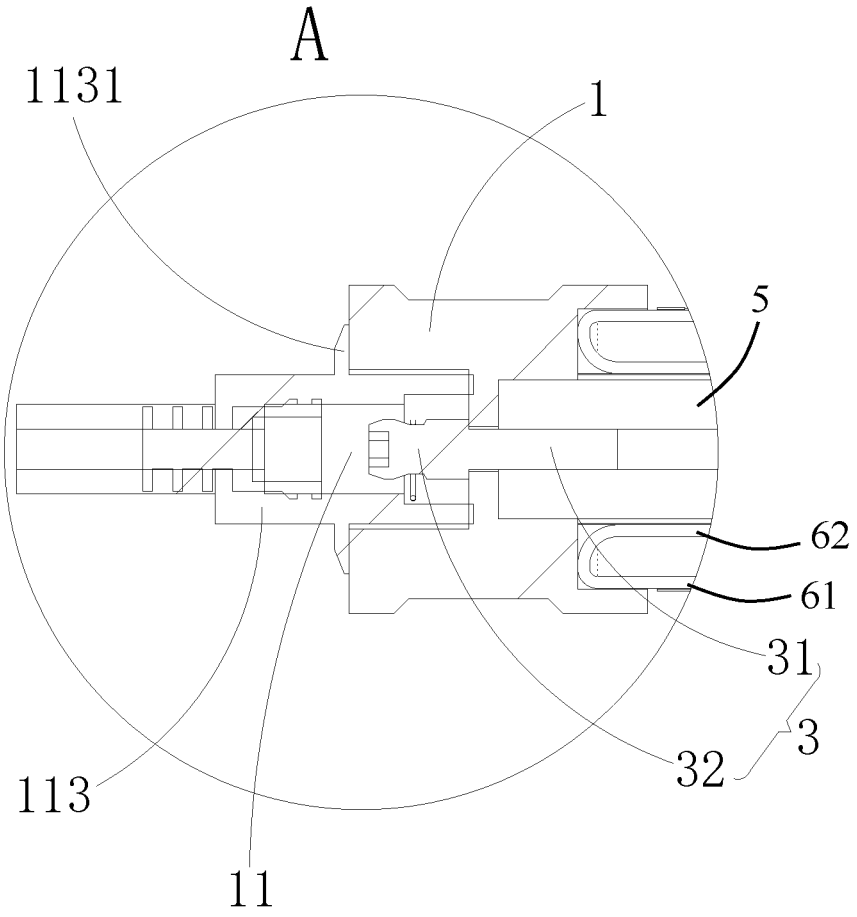
FIG. 3 is a closeup cross sectional view of area A in FIG. 2.

Furthermore, in the embodiment shown in the figures, a first electrode buckle 11 is connected to the first electrode head 3 using a bayonet slot connection. As shown in FIG. 6 the outer wall in the middle of the first electrode head outer connecting section 32 is recessed inward to form a first annular groove 321. The excimer lamp also comprises a first electrode buckle 11 for clamping with the outer connecting section 32. The first electrode buckle 11 has a first insertion section 111 embedded in the first lamp cap 1 and a first extension section 112 protruding from the first lamp cap 1. The first lamp cap 1 is not shown in FIG. 6 but is shown in FIG. 3. The first extension section 112 is used to connect to the external power source. The first insertion section 111 has a first axial opening 1111. The fifth connection section 32 is inserted into the first axial opening 1111. The outer wall of the first insertion section 111 is provided a first positioning restriction slot 1112. The first positioning restriction slot 1112 penetrates the first axial opening 1111. The first positioning restriction slot 1112 is arranged to correspond with the first annular groove 321 of the outer connecting section 32 when the outer connecting section 32 is inserted into the first axial opening 1111. There is a first elastic circlip 1113 inside the first positioning restriction slot 1112. The first elastic circlip 1113 can be positioned around the first annular groove 321 to restrict the position of the fifth connecting section 32. The first electrode buckle 11 is used to connect to an external power source. The first electrode head 3 can be directly connected to the first electrode buckle 11 to realize the connection to an external power source and convenience for assembly.

A corresponding bayonet slot arrangement is shown in FIG. 7 for the second electrode head 4. The outer wall in the middle of the second electrode head outer connecting section 42 of the second electrode head 4 is recessed inward to form a second annular groove 421. The excimer lamp also comprises a second electrode buckle 23 for clamping with the second electrode head outer connecting section 42. The second electrode buckle 23 has a second embedding section 231 which embeds into the second lamp cap 2, and a second extension section 232 which extends out of the second lamp cap 2. The second cap 2 is not shown in FIG. 7 but is shown in FIG. 5. The second extension section 232 is used to connect to an external power source. The second embedding section 231 has a second axial opening 2311. The second connecting section 42 is embedded into the second axial opening 2311. The outer wall of the second embedding section 231 has a second positioning restriction slot 2312. The second positioning restriction slot 2312 penetrates the second axial opening 2311. The second positioning restriction slot 2312 is arranged opposite to the second annular groove 421 of the second connecting section 42. There is a second elastic circlip 2313 inside the second positioning restriction slot 2312. The second elastic circlip 2313 can restrict the position of the second connecting section 42. The second electrode buckle 23 is used to connect to an external power source, and the second electrode head 4 can be directly connected to the second electrode buckle 23 to realize the connection to the external power source and convenience for assembly.

In the embodiment shown in FIG. 3, there is a first electrode buckle protective sleeve 113 surround the outer surface of the first electrode buckle 11. There is a first protective ring 1131 at the middle ring of the first protective sleeve 113. The first protective ring is used to seal the gap between the first lamp cap 1 and the first protective sleeve 113. As shown in FIG. 5, the second electrode buckle 23 is sheathed with a second electrode buckle protective sleeve 233. In the middle of the second electrode buckle protective sleeve 233 there is a second protective ring 2331. The second protective ring 2331 is used to seal the gap between the second lamp cap 2 and the second protective sleeve 233. The first protective sleeve 113, the first protective ring 1131, the second protective sleeve 233, and the second protective ring 2331 can effectively prevent a human body from contacting the high voltage electricity and prevent personal injury. The second electrode may be grounded so that the conductive ring net 7 is not at high voltage. The second electrode may be a negative electrode (cathode) relative to the positive first electrode (anode) while being held at ground or low voltage relative to ground. Regardless of whether the second electrode is at high voltage or nor, a cover (not shown) may also be present around the light-transparent annular sleeve 6 outside the conductive ring net 7 to provide protection from shock depending on the user environment. The cover may be formed of, for example, silica glass.

The above embodiment is suitable to generate light in a full 360 degrees around a cylindrical light source. If directed light is preferred, this may be combined with, for example, a mirror to direct the light. The embodiment presented may also be modified to produce light in less than 360 degrees. For example the conductive ring net 7 may extend only partially around the tube so long as any position of the conductive ring net 7 keeps about the same distance to the surface of the first electrode to obtain relative even discharging. Other components, such as the light-transparent annular sleeve 6 and heat dissipation units 10, may likewise only extend part of the way around in such an embodiment.

Figure 13:
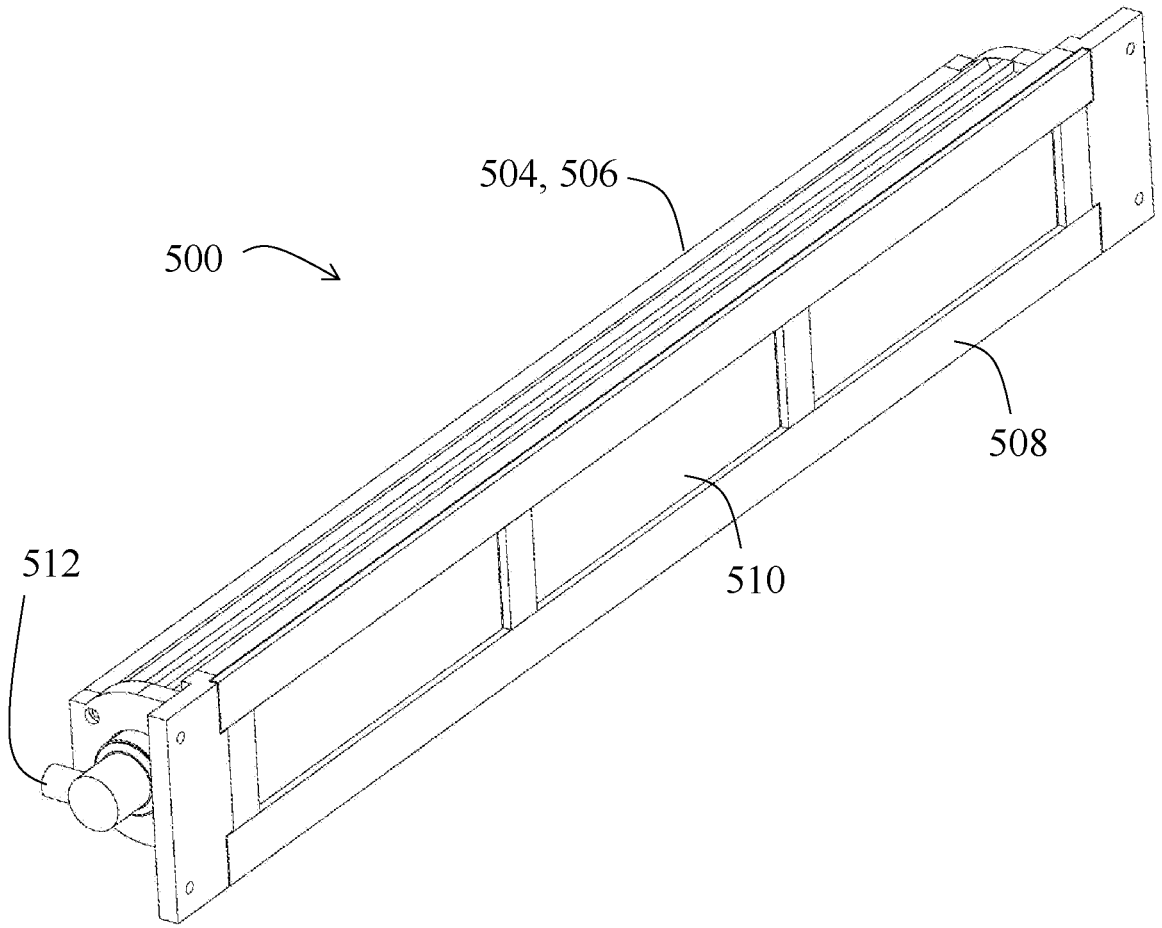
FIG. 13 is an isometric view of a fixture containing an excimer lamp.
Figure 14:
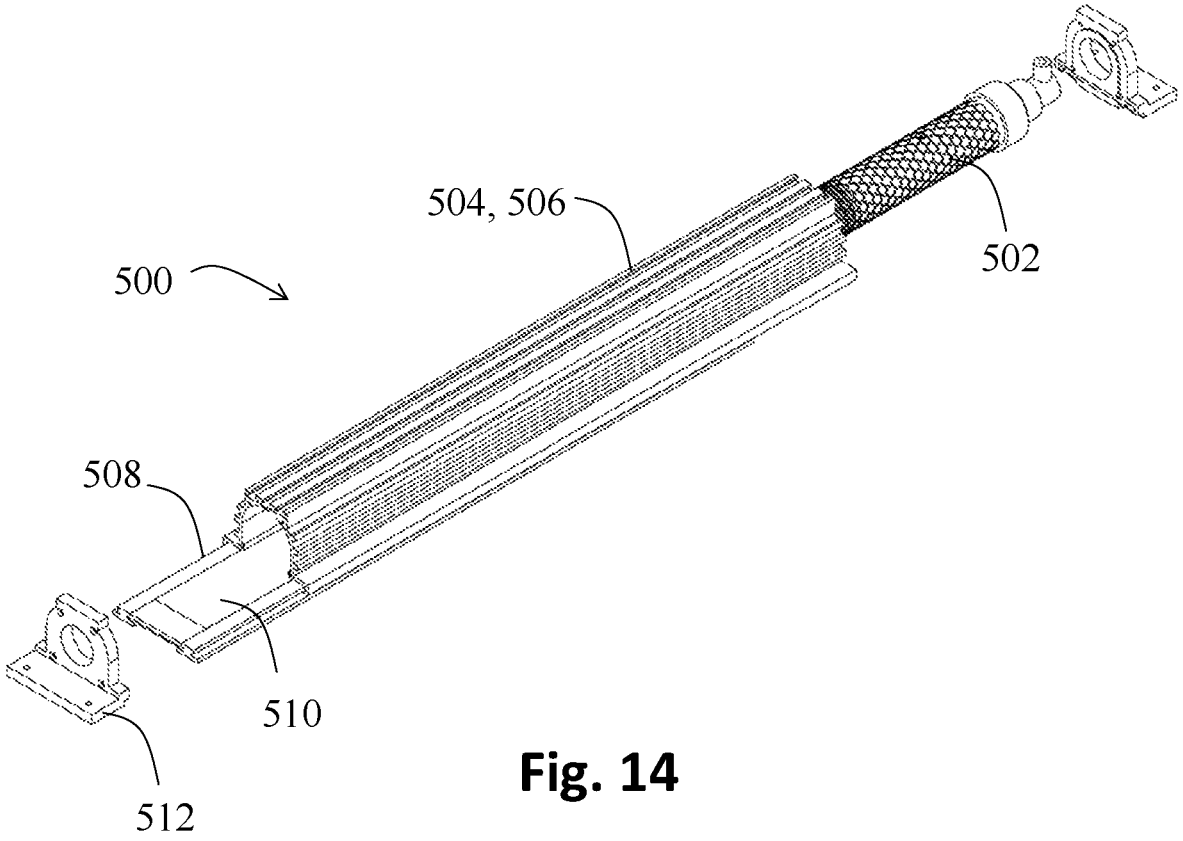
FIG. 14 is a partially exploded isometric view of the fixture and excimer lamp of FIG. 13.

An excimer lamp, for example as described above, may be installed in a fixture 500 for example as illustrated in FIG. 13. FIG. 14 shows a partially exploded view of the lighting fixture 500 containing an excimer lamp 502 within housing 504. Other UVC (e.g. 222 nm) light sources could also be used. The housing 504 shown in FIG. 14 includes a U-shaped cover 506 with a sliding mount for a window structure 508 defining a window 510 for the UVC light to exit the fixture. Other mounts could be used, or the cover 506 could define the window directly. There are also fixture endcaps 512. An interior surface of the cover 506 can be reflective and shaped with an appropriate curve to direct far UVC light from the lamp 502 to the window 510, or a separate mirror (not shown) may be provided to direct the light to the window.

Figure 15:
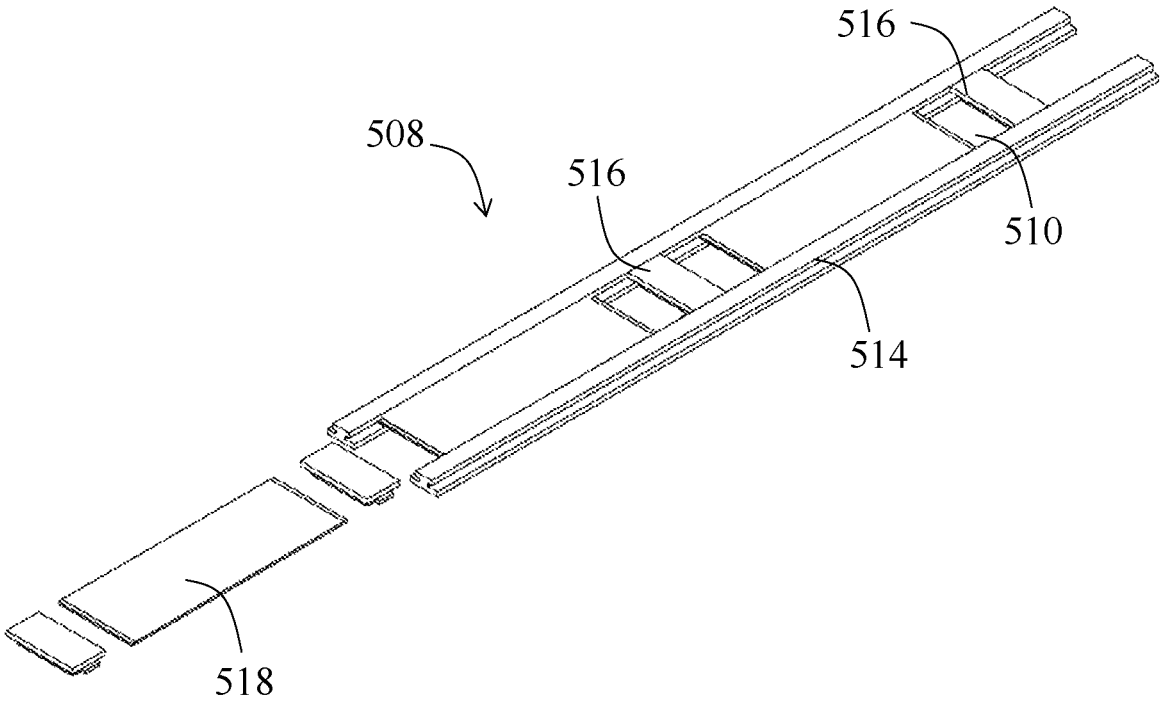
FIG. 15 is a partially exploded isometric view of a window structure of the fixture of FIG. 13.

FIG. 15 shows the window structure 508 from FIGS. 13-14 in more detail. The window structure in this embodiment comprises side rails 514 holding crossbars 516. The side rails 514 and crossbars 516 define windows 510 containing lenses 518. The crossbars 516 and lenses 518 may both be slidable along the rails 514. The crossbars 516 provide structural strength and reduce cost compared with a single larger lens. The lenses 518 can be wavelength filtering lenses, for example letting through 222 nm UVC light and stopping other, harmful wavelengths. A wavelength filter could also be placed in windows 510 without any lensing functionality.

Figure 16:
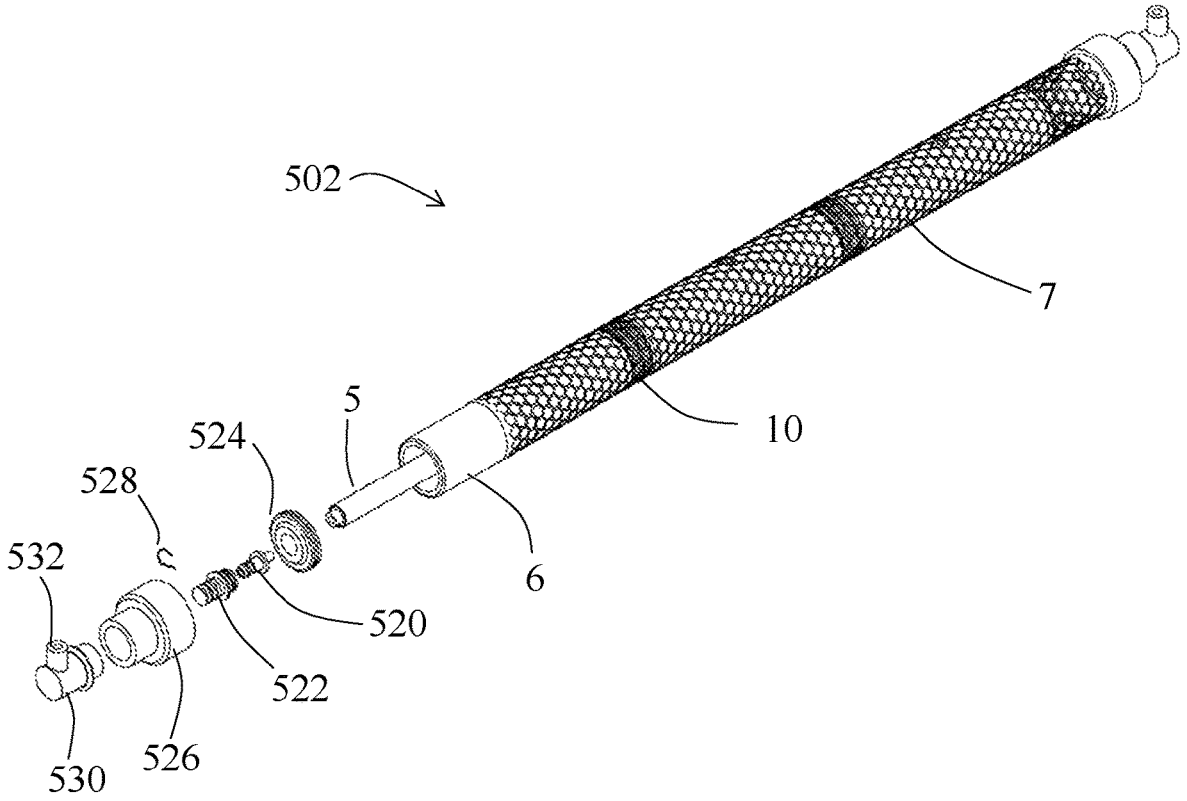
FIG. 16 is a partially exploded view of the excimer lamp of FIG. 13.

FIG. 16 shows an embodiment of an excimer lamp 502. FIG. 14 shows this embodiment in a fixture, but the embodiment shown in FIGS. 1-12 could also be used in such a fixture, or other excimer lamp or UVC light embodiments. As in the embodiment shown in FIGS. 1-12, the embodiment shown in FIG. 16 includes a conductive ring net 7, which may be for example a stainless steel mesh, surrounding axially separated light transparent annular sleeve segments 6, separated by heat dissipation units 10, which may be for example ceramic pads, for example including fins as shown in FIG. 10. A conductive heat dissipation rod 5, which may be for example a hollow steel bar, runs within the sleeves. Electrode head 520 connects to the conductive heat dissipation rod 5 by a threaded connection. Electrode connector 522 may be a buckle connecting to the electrode head 520 using a bayonet slot connection with circlip 528 to hold the electrode connector 522 in place. Any other suitable connection type may also be used.

A ceramic pad 524 may be placed onto the conductive heat dissipation rod 5 to abut the annular sleeve 6. A cap 526, for example of ceramic, is placed over the electrode head 520 and contacts the conductive heat dissipation rod 5. The arrangement of the cap 526 and other end components is better shown in FIG. 17, but FIG. 17 omits the electrode head 520. An electrically insulative cap outer cap 530, for example of rubber, is inserted within the cap 526 and over the electrode connector 522, and includes an opening 532 to accommodate a conductor to supply a voltage to the conductive heat dissipation rod 5 through the electrode connector 522 and electrode head 520. The outer cap 530 is here fixed to the electrode conductor 522 via a series of flexible inner restrictions 534 intermeshing with a corresponding series of flanges 536 of the electrode connector 522.

At the opposite end of the lamp an incoming conductor may be electrically connected to the conductive ring net 7, for example using a fixing nut 21 as shown in FIG. 5.

Figure 17:
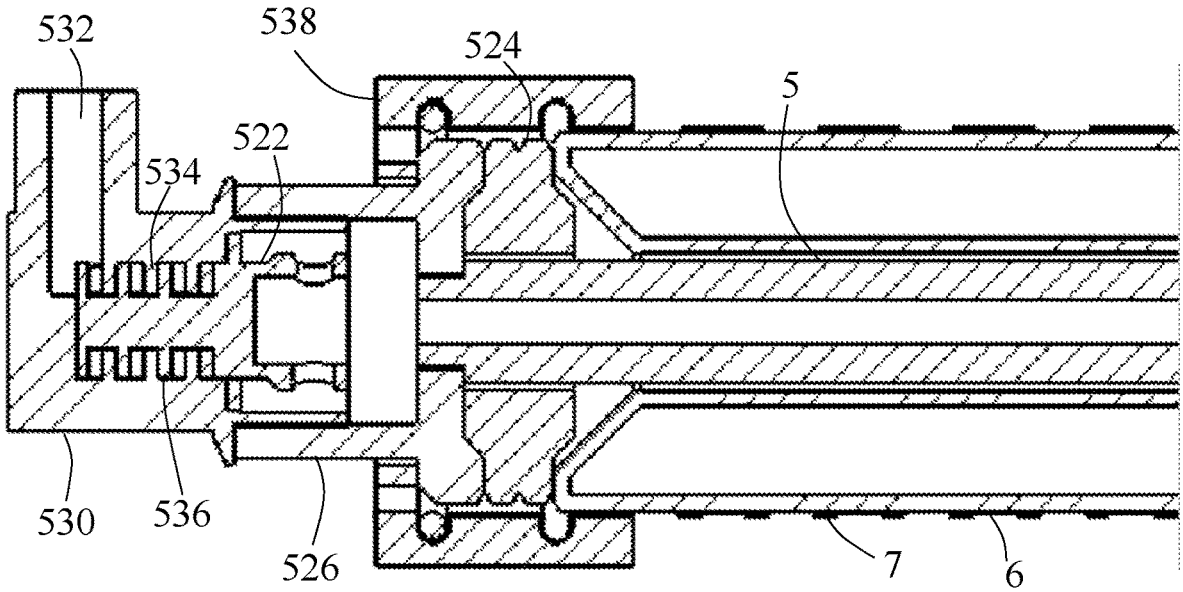
FIG. 17 is a closeup side section view of an end of an excimer lamp.

FIG. 17 shows a closeup cross sectional side view of a first end of an excimer lamp. In the embodiment shown in FIG. 17, an external metal ring 538 is installed around cap 526 and contacting conductive ring net 7. The metal ring 538 may accommodate the annular ring 71 of the conductive ring net 7 within, in an embodiment, one of two annular cavities 550 of the external metal ring 538. A conductor may connect to the metal ring 538, for example by insertion into a hole 540 in the metal ring 538, in order to supply a voltage to the conductive ring net 7. This allows both the conductive ring net 7 and conductive heat dissipation rod 5 to be supplied with different voltages from a single end of the lamp. The other end may not need to be connected to conductors at all or can have, for example, an identical arrangement to that of the end shown. For safety purposes, the voltage supplied to metal ring 538 may be a ground voltage supplied by a ground wire, while the conductive heat dissipation rod 5 is supplied by a live wire with varying positive voltage as described above.

In an embodiment, the metal ring 538 is connected to both negative and ground wires, the negative wire being negative relative to the varying positive voltage of the positive wire but at ground voltage.

Figure 18:
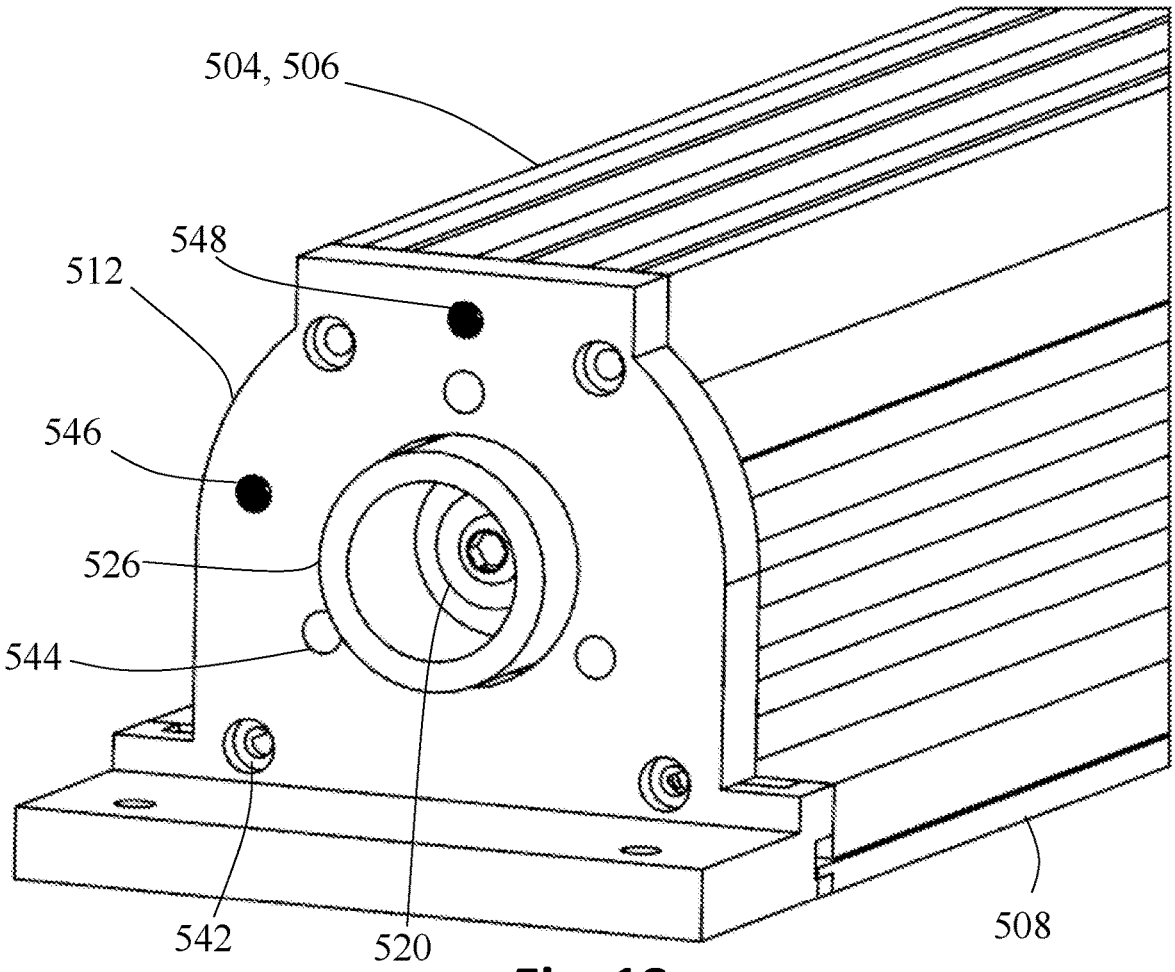
FIG. 18 is a closeup isometric view of an end of a fixture containing an excimer lamp.

FIG. 18 shows a closeup of a housing 504 and a fixture endcap 512. Lamp cap 526 is seen extending out of the fixture endcap 512 with electrode head 520 visible within lamp cap 526. The outer cap 530 and electrode connector 522 are omitted from this figure. The fixture endcap 512 is here shown fixed to the cover 506 using screws 542. The endcap is also shown fixed to the lamp cap 526 by inner screws 544. Further screws 546 and 548 connect to the metal ring 538, and in an embodiment serve as cathode and ground terminal connections respectively.

The above descriptions are only preferred embodiments of the present invention and do not limit the present invention as defined by the claims. Modifications, equivalent replacements and improvements may be made without departing from the claims.

The invention claimed is:

1. An excimer lamp comprising:

a conductive heat dissipation rod having a first end and a second end, and extending in a longitudinal direction from the first end to the second end;

a first lamp cap connected to the first end of the conductive heat dissipation rod, the first lamp cap being thermally conductive but electrically non-conductive;

a first electrode head installed in the first lamp cap, the first electrode head being configured to connect to an external power source, and the first electrode head electrically connected to the conductive heat dissipation rod;

a light-transparent annular sleeve extending in the longitudinal direction, the light-transparent annular sleeve arranged around the conductive heat dissipation rod and defining a gas containment space filled with an excimer gas;

a conductive annular net arranged around the light-transparent annular sleeve and extending in the longitudinal direction;

a second electrode head, the second electrode head being electrically connected to the conductive annular net, the second electrode head being configured to connect to the external power source; and a second lamp cap connected to the second end of the conductive heat dissipation rod, the second lamp cap being thermally conductive but electrically non-conductive.

2. The excimer lamp of claim 1 in which the second lamp cap is installed around the second electrode head.

3. The excimer lamp of claim 2 in which the second electrode head comprises a second electrode head inner connecting section connected to a contact for electrically connecting the second electrode head to the conductive ring net, the contact being separated from the conductive heat dissipation rod by an insulator and the second electrode head also comprises a second electrode head outer connecting section connected to a second electrode buckle for supplying external power from the external power source through the second electrode head.

4. The excimer lamp of claim 3 in which the second electrode buckle extends out of the second lamp cap, a connecting portion connecting to the second electrode head outer connecting section within the second lamp cap.

5. The excimer lamp of claim 4 in which the second electrode buckle is connected to the second electrode head using a bayonet slot connection.

6. The excimer lamp of claim 3 further comprising a second electrode buckle protective sleeve surrounding an outer surface of the second electrode buckle, the second electrode buckle protective sleeve including an outwardly projecting ring adjacent to an outer surface of the second lamp cap.

7. The excimer lamp of claim 3 in which the contact comprises a flange.

8. The excimer lamp of claim 7 in which the second electrode head extends through a restriction in the second lamp cap and the second lamp cap is constrained around the second electrode head in part by the flange.

9. The excimer lamp of claim 7 in which the conductive ring net has an end which bends inwardly around the flange to form an annular ring in contact with the flange.

10. The excimer lamp of claim 9 in which the annular ring is pressed against the flange.

11. The excimer lamp of claim 3 in which the contact is threadedly connected to the second electrode head inner connecting section.

12. The excimer lamp of claim 3 in which the insulator separating the contact from the conductive heat dissipation rod is a ceramic insulator.

13. The excimer lamp of claim 3 in which the insulator includes an insulator connecting section in mating contact with the conductive heat dissipation rod.

14. The excimer lamp of claim 1 in which the light-transparent annular sleeve comprises an inner sleeve and an outer sleeve, the outer sleeve connecting to the inner sleeve to enclose and define the gas containment space between the inner sleeve and the outer sleeve.

15. The excimer lamp of claim 14 in which the excimer lamp also comprises a conductive heat dissipation tube extending in the longitudinal direction and having an inner wall surrounding the conductive heat dissipation rod and separated from the conductive heat dissipation rod by a gap, the gap filled with an elastic conductive material; the conductive heat dissipation tube having an outer wall adjacent to the inner sleeve.

16. The excimer lamp of claim 1 in which there is more than one light transparent annular sleeve, the more than one light transparent annular sleeves being separated axially by rings adapted to dissipate heat.

17. The excimer lamp of claim 1 in which the first electrode head includes a first electrode head inner connecting section having an external thread threadedly connected with the conductive heat dissipation rod.

18. The excimer lamp of claim 1 in which the first electrode head incudes a first electrode head outer connecting section, the excimer lamp further comprising a first electrode buckle for clamping with the first electrode head outer connecting section, the first electrode buckle having a first insertion section embedded in the first lamp cap and a first extension section protruding from the first lamp cap for connection to the external power source.

19. The excimer lamp of claim 18 in which the first electrode buckle is connected to the first electrode head using a bayonet slot connection.

20. The excimer lamp of claim 18 further comprising a first electrode buckle protective sleeve surrounding an outer surface of the first electrode buckle, the first electrode buckle protective sleeve including an outwardly projecting ring adjacent to an outer surface of the first lamp cap.

21. A fixture comprising:

an excimer lamp as claimed in claim 1;

a housing containing the excimer lamp; and a window extending along the housing.

22. The fixture of claim 21 further comprising a lens in the window.

23. The fixture of claim 22 in which the lens comprises a wavelength filter.

24. The fixture of claim 22 in which the lens comprises plural lenses.

25. The fixture of claim 24 further comprising reinforcing bars arranged between the plural lenses.

26. The fixture of claim 21 further comprising a mirror within the housing arranged to direct light from the excimer lamp to the window.

27. The fixture of claim 26 in which the mirror is an interior surface of the housing.

28. The fixture of claim 21 in which the fixture has a first fixture end cap at a first end of the fixture, a portion of the excimer lamp extending through the first fixture end cap.

29. The fixture of claim 28 in which the lamp is energized via power flow between a first terminal and a second terminal, the first terminal being connected to the portion of the excimer lamp extending through the first fixture end cap, and the second terminal being connected to the excimer lamp via a conduit through the first fixture end cap.

* * * * *